US012662890B1

(12) United States Patent
Subotic et al.

(10) Patent No.: US 12,662,890 B1
(45) Date of Patent: Jun. 23, 2026

(54) ROTATING CONTROL DEVICE WITH VARIABLE PRESSURE COMPENSATION

(71) Applicant: Schlumberger Technology Corporation, Sugar Land, TX (US)

(72) Inventors: Milan Subotic, Katy, TX (US); Jeffrey Ham, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/195,379

(22) Filed: Apr. 30, 2025

(51) Int. Cl.
*E21B 21/08* (2006.01)
*E21B 21/00* (2006.01)
*E21B 33/08* (2006.01)

(52) U.S. Cl.
CPC ..... *E21B 21/08* (2013.01); *E21B 21/003* (2013.01); *E21B 33/085* (2013.01)

(58) Field of Classification Search
CPC ..... E21B 21/08; E21B 21/003; E21B 33/085
See application file for complete search history.

(56) References Cited

U.S. PATENT DOCUMENTS

| | | | | |
|---|---|---|---|---|
| 6,227,547 | B1 | 5/2001 | Dietle | |
| 6,263,982 | B1 | 7/2001 | Hannegan | |
| 6,470,975 | B1 | 10/2002 | Bourgoyne | |
| 6,913,092 | B2 | 7/2005 | Bourgoyne | |
| 7,040,394 | B2 | 5/2006 | Bailey | |
| 7,258,171 | B2 | 8/2007 | Bourgoyne | |
| 8,096,711 | B2 | 1/2012 | Beauchamp | |
| 8,376,366 | B2 | 2/2013 | Richards | |
| 8,500,337 | B2 | 8/2013 | Beauchamp | |
| 9,085,940 | B2 | 7/2015 | Orbell | |
| 9,157,285 | B2 | 10/2015 | Orbell | |
| 9,284,811 | B2 | 3/2016 | Michaud | |
| 10,240,426 | B2 | 3/2019 | Grace | |
| 10,267,117 | B2 | 4/2019 | Bailey | |
| 11,236,575 | B2 * | 2/2022 | Dietrich | E21B 33/085 |
| 2012/0217022 | A1 * | 8/2012 | Michaud | E21B 33/085 384/477 |
| 2019/0093445 | A1 | 3/2019 | Kulkarni | |
| 2022/0333463 | A1 * | 10/2022 | Steele | E21B 41/0035 |

* cited by examiner

*Primary Examiner* — Nicole Coy
*Assistant Examiner* — Nicholas D Wlodarski
(74) *Attorney, Agent, or Firm* — Jeffrey D. Frantz

(57) ABSTRACT

A rotating control device (RCD) includes: a drive guide element surrounding a tubular and co-rotating with the tubular; a bearing housing comprising a bearing assembly for rotatably supporting the drive guide element; a rotary seal housing comprising rotary seals surrounding the drive guide element and limiting ingress of a working fluid flowing around the tubular into the bearing housing, the rotary seals arranged in the axial direction; fluid lines communicating with radial passages containing a pressure compensating fluid for controlling a pressure differential across the rotary seals; and a variable pressure compensating device positioned in at least one fluid line, wherein the variable pressure compensating device operates to build pressure of the pressure compensating fluid in at least one of the radial passages communicating with the at least one of the fluid lines when a leak across at least one of the rotary seals occurs.

20 Claims, 9 Drawing Sheets

ROTATING CONTROL DEVICE WITH VARIABLE PRESSURE COMPENSATION

TECHNICAL FIELD

This disclosure relates in general to fluid drilling equipment and in particular to a rotating control device (RCD) for drilling operations.

BACKGROUND

Rotating control devices (RCDs) are used in onshore and offshore drilling systems for controlling flow and/or pressure of fluid exiting a wellbore. An RCD may include one or more sealing elements (e.g., elastomeric seals) that provide an annular seal around the drill string and are rotatably supported by bearings. Rotary seals isolate the bearings from the fluid exiting the wellbore, which may be corrosive and/or include abrasive particles. The rotary seals may leak due to significant pressure experienced by the seals via the fluid exiting the wellbore.

SUMMARY

The present disclosure provides a variable pressure compensating mechanism for one or more rotary seals used in rotating control devices (RCDs). The variable pressure compensating mechanism operates to gradually reduce a pressure differential across the one or more rotary seals in response to a fluid leak at the seal to eventually stop or limit the leak and prevent or limit damage and/or premature wear of bearings in the RCD. The variable pressure compensating mechanism may utilize internal fluid that is also supplied to the bearings such that the variable pressure compensating mechanism may be operable without an external pressure source for compensating the pressure differential across the rotary seal(s).

In one independent aspect, provided herein is a rotating control device (RCD) defining a longitudinal passage through which a tubular extends in an axial direction. The RCD comprises: a drive guide element surrounding the tubular and co-rotating with the tubular; a bearing housing comprising at least one bearing assembly for rotatably supporting the drive guide element; a rotary seal housing comprising a plurality of rotary seals surrounding the drive guide element and limiting ingress of a working fluid flowing around the tubular into the bearing housing, the plurality of rotary seals arranged in the axial direction; a plurality of fluid lines communicating with a plurality of radial passages containing a pressure compensating fluid for controlling a pressure differential across the plurality of rotary seals; and at least one variable pressure compensating device positioned in at least one of the plurality of fluid lines, wherein the at least one variable pressure compensating device operates to build pressure of the pressure compensating fluid in at least one of the radial passages communicating with the at least one of the plurality of fluid lines when a leak across at least one of the plurality of rotary seals occurs.

In some aspects, the at least one variable pressure compensating device comprises a moveable member positioned in a chamber and moveable therein in response to excessive pressure compensating fluid in the at least one of the radial passages when the leak across the at least one of the plurality of rotary seals occurs.

In some aspects, the moveable member is a piston operably connected with a biasing means that controls movement of the piston in the chamber.

In some aspects, the plurality of rotary seals comprises a first rotary seal and a second rotary seal positioned axially downstream from the first rotary seal. In some aspects, the plurality of radial passages comprises at least one first radial passage positioned axially downstream from the first rotary seal and at least one second radial passage positioned axially downstream from the second rotary seal. In some aspects, the plurality of fluid lines comprises at least one first fluid line communicating with the at least one first radial passage and at least one second fluid line communicating with the at least one second radial passage. In some aspects, the at least one variable compensating device is positioned in the at least one second fluid line. In some aspects, the RCD further comprises a pressure compensation housing defining a pressure compensating chamber communicating with the at least one first radial passage, wherein a pressure compensating piston is positioned in the pressure compensating chamber and moveable therein in response to flow of the working fluid, wherein movement of the pressure compensating piston builds pressure of the pressure compensating fluid in the at least one first radial passage. In some aspects, the at least one first fluid line comprises multiple first fluid lines, at least one of the first fluid lines supplying the pressure compensating fluid to the at least one first radial passage and at least one other of the first fluid lines providing clearance for overflow of the pressure compensating fluid in the at least one first radial passage. In some aspects, the at least one second fluid line comprises multiple second fluid lines, at least one of the second fluid lines supplying the pressure compensating fluid to the at least one second radial passage and at least one other of the second fluid lines providing clearance for overflow of the pressure compensating fluid in the at least one second radial passage. In some aspects, the at least one first fluid line is isolated from the at least one second fluid line.

In some aspects, the plurality of fluid lines extend through the bearing housing and the rotary seal housing toward the plurality of radial passages. In some aspects, the plurality of fluid lines are defined at discrete circumferential positions.

In some aspects, the RCD further comprises at least one bearing fluid line communicating with an internal volume of the bearing housing. In some aspects, the at least one bearing fluid line extends through the bearing housing at a discrete circumferential position.

In some aspects, the plurality of radial passages are isolated from one another via the plurality of rotary seals.

In some aspects, the plurality of rotary seals are supported by a plurality of seal retainers. In some aspects, the plurality of seal retainers define at least some of the plurality of radial passages.

In another independent aspect, provided herein is a system comprising a rotating control device (RCD) defining a longitudinal passage and a tubular extending through the longitudinal passage of the RCD in an axial direction. In some aspects, the RCD comprises: a drive guide element surrounding the tubular and co-rotating with the tubular; a bearing housing comprising at least one bearing assembly for rotatably supporting the drive guide element; a rotary seal housing comprising a plurality of rotary seals surrounding the drive guide element and limiting ingress of a working fluid flowing around the tubular into the bearing housing, the plurality of rotary seals arranged in the axial direction; a plurality of fluid lines communicating with a plurality of radial passages containing a pressure compensating fluid for controlling a pressure differential across the plurality of rotary seals; and at least one variable pressure compensating device positioned in at least one of the plurality of fluid lines, wherein the at least one variable pressure compensating device operates to build pressure of the pressure compensating fluid in at least one of the radial passages communicating with the at least one of the plurality of fluid lines when a leak across at least one of the plurality of rotary seals occurs.

In some aspects, the system further comprises a fluid system supplying the working fluid through the tubular toward a bottom of a wellbore. In some aspects, the working fluid returns from the wellbore via an annulus surrounding the tubular. In some aspects, the plurality of rotary seals limit ingress of the returning working fluid into the bearing housing.

In some aspects, the at least one variable pressure compensating device comprises a piston positioned in a chamber and moveable therein in response to excessive pressure compensating fluid in the at least one of the radial passages when the leak across the at least one of the plurality of rotary seals occurs. In some aspects, the piston is operably coupled with a biasing means that controls movement of the piston in the chamber.

In some aspects, the plurality of rotary seals comprises a first rotary seal and a second rotary seal positioned axially downstream from the first rotary seal. In some aspects, the plurality of radial passages comprises at least one first radial passage positioned axially downstream from the first rotary seal and at least one second radial passage positioned axially downstream from the second rotary seal. In some aspects, the plurality of fluid lines comprises at least one first fluid line communicating with the at least one first radial passage and at least one second fluid line communicating with the at least one second radial passage. In some aspects, the at least one variable pressure compensating device is positioned in the at least one second fluid line. In some aspects, the RCD further comprises a pressure compensation housing defining a pressure compensating chamber communicating with the at least one first radial passage. In some aspects, a pressure compensating piston is positioned in the pressure compensating chamber and moveable therein in response to flow of the working fluid. In some aspects, movement of the pressure compensating piston builds pressure of the pressure compensating fluid in the at least one first radial passage.

In another independent aspect, provided herein is a method of operating a drilling system. The method may comprise: supplying a working fluid through a tubular into a wellbore for performing one or more downhole operations using the tubular; controlling flow of the working fluid returning from the wellbore through an annulus surrounding the tubular using a rotating control device (RCD); and isolating a bearing housing of the RCD from the flow of the working fluid returning from the wellbore using a plurality of rotary seals, wherein, when a leak across at least one of the plurality of rotary seals occurs, at least one variable pressure compensating device of the RCD operates to build pressure of the pressure compensating fluid in at least one of the radial passages to control the leak.

In some aspects, the RCD comprises: a drive guide element surrounding the tubular and co-rotating with the tubular; the bearing housing comprising at least one bearing assembly for rotatably supporting the drive guide element; a rotary seal housing comprising the plurality of rotary seals surrounding the drive guide element and limiting ingress of a working fluid flowing around the tubular into the bearing housing, the plurality of rotary seals arranged in the axial direction; a plurality of fluid lines communicating with a plurality of radial passages containing a pressure compensating fluid for controlling a pressure differential across the plurality of rotary seals; and the at least one variable pressure compensating device positioned in at least one of the plurality of fluid lines, wherein the at least one variable pressure compensating device operates to build pressure of the pressure compensating fluid in at least one of the radial passages communicating with the at least one of the plurality of fluid lines when a leak across at least one of the plurality of rotary seals occurs.

In some aspects, the method further comprises building pressure of the pressure compensating fluid in another one of the radial passages upstream from the at least one of the radial passages using a pressure compensating piston positioned in a pressure compensating housing before the leak across the at least one of the plurality of rotary seals occurs.

The following description and the appended figures set forth certain features for purposes of illustration. Advantages will become more apparent when reading the present disclosure in its entirety.

BRIEF DESCRIPTION OF DRAWINGS

So that the manner where the above recited features may be understood in detail, a more particular description, briefly summarized above, may be had by reference to example aspects, some of which are illustrated in the appended drawings.

Corresponding reference numerals used throughout the drawings indicate corresponding features, elements, and components.

DETAILED DESCRIPTION

One or more specific embodiments of the present disclosure will be described herein. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. More-over, it should be appreciated that such a development effort might be complex and time consuming, but would nevertheless be a routine undertaking of design, fabrication, and manufacture for those of ordinary skill having the benefit of this disclosure.

The present disclosure relates to rotating control devices (RCDs) that can be used to manage pressure and/or control flow of working fluid exiting a wellbore in drilling applications. RCDs according to embodiments of this disclosure may include rotary seals that create fluid-tight seals between a tubular (e.g., a drill string) extending through the RCD and a stationary housing surrounding the tubular. Pressure compensating fluid is supplied to passages located behind the rotary seals and can be pressurized to reduce a pressure differential experienced across the rotary seals and prevent leaks. The pressure compensating fluid behind a first rotary seal which is first in line for the working fluid exiting the wellbore is pressurized using a piston ring that moves in response to flow of the working fluid. The pressure compensating fluid behind the remaining one or more rotary seals downstream from the first rotary seal remains unpressurized until a leak occurs across the respective rotary seal. One or more variable pressure compensating devices are provided that operate to build pressure in the pressure compensating fluid behind the downstream rotary seals when the leak occurs. In this way, the RCDs of this disclosure provide cascading or staged pressure compensation to control leaks across the rotary seals. The RCDs of this disclosure may advantageously employ internal pressure compensation using the pressure compensating fluid that is internally contained in the RCD without requiring external pressure compensation sources.

Figure 1:
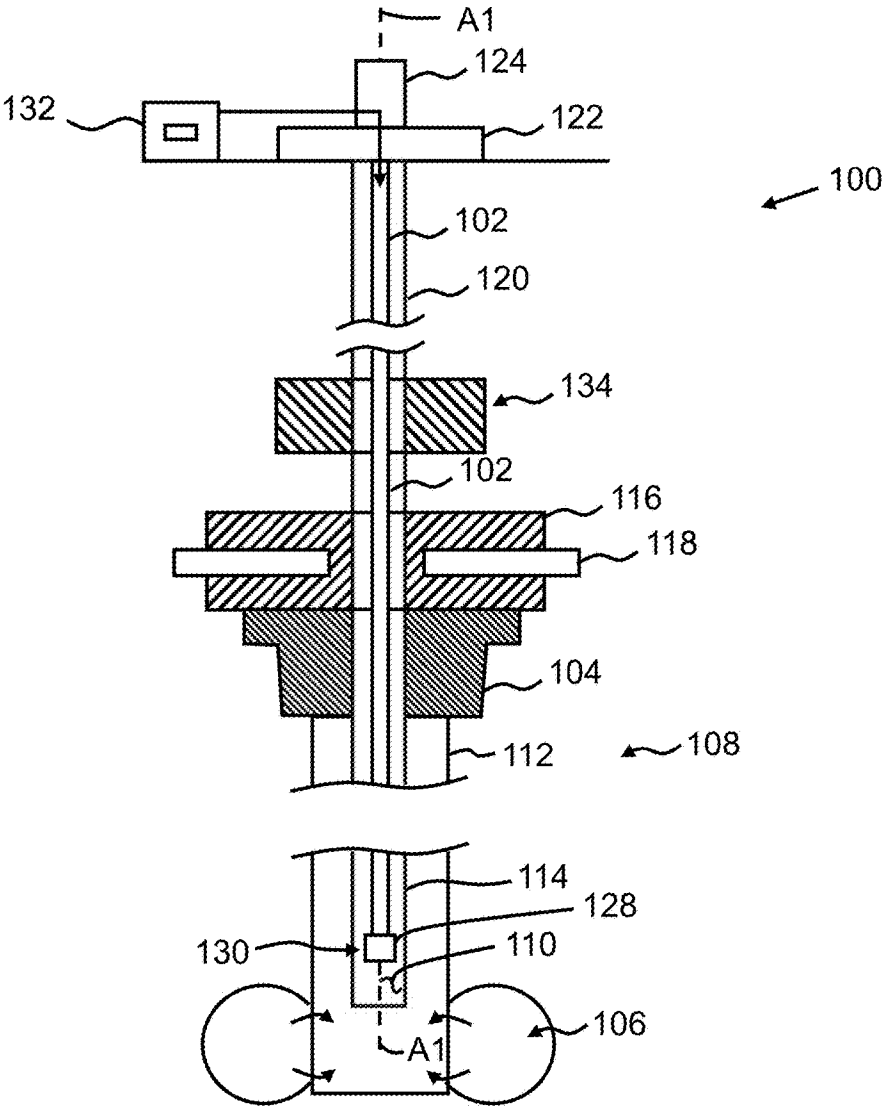
FIG. 1 is a schematic diagram of a drilling system.

Referring now to the drawings, FIG. 1 depicts an embodiment of a drilling system 100 that is configured to perform one or more downhole operations via a tubular 102 (e.g., a drill string). For example, the drilling system 100 may be configured to perform downhole operations such as, for example, drilling, tripping (tripping in or out), reaming, wiper tripping, and/or another downhole operation that utilizes operation of the tubular 102 (e.g., via translation or rotation of the tubular). In some embodiments, the drilling system 100 may be a subsea or offshore system. In some embodiments, the drilling system may be a land-based (e.g., onshore or surface) system.

In the illustrated embodiment, the drilling system 100 includes a wellhead assembly 104 coupled to a mineral deposit 106 via a well 108 having a wellbore 110. The wellhead assembly 104 may include or be coupled to multiple components that control and regulate activities and conditions associated with the well 108. For example, the wellhead assembly 104 may include or be coupled to pipes, bodies, valves, and seals that enable drilling of the well 108, route produced minerals from the mineral deposit 106, provide for regulating pressure in the well 108, and/or provide for the injection of drilling fluids into the wellbore 110. A conductor 112 may provide structure for the wellbore 110 and may block collapse of the sides of the well 108 into the wellbore 110. A casing 114 may be disposed within the conductor 112. The casing 114 may provide structure for the wellbore 110 and may facilitate control of fluid and pressure during drilling of the well 108. The wellhead assembly 104 may include a tubing spool, a casing spool, and a hanger (e.g., a tubing hanger or a casing hanger) to enable installation of the casing 114.

In some embodiments, the wellhead assembly 104 may include or may be coupled to a blowout preventer (BOP) assembly 116. The BOP assembly 116 can include various known types of BOPs. In general, the BOP assembly 116 may be operable to seal and control well production to prevent uncontrolled release of fluids (e.g., oil and/or gas) from the well 108. In some embodiments, the BOP assembly 116 may include one or more ram BOPs. For example, the BOP assembly 116 shown in FIG. 1 includes a ram BOP having moveable rams 118 configured to seal the wellbore 110.

A drilling riser 120 may extend between the BOP assembly 116 and a platform 122. The platform 122 may include various components that facilitate operation of the drilling system 100, such as pumps, tanks, and power equipment. The platform 122 may also include a derrick 124 that supports the tubular 102 (e.g., drill string). The tubular 102 may extend through the drilling riser 120. A drill bit 128 may be positioned at or proximate a distal end 130 of the tubular 102. The tubular 102 may rotate about an axis A1 within the drilling riser 120 to rotate the drill bit 128, thereby enabling the drill bit 128 to drill and form the well 108.

A drilling fluid system 132 may direct working fluid (e.g., drilling fluid or drilling mud) into the tubular 102. The working fluid may exit through one or more openings at or proximate the distal end 130 of the tubular 102. The working fluid may return (along with cuttings and/or other substances from the well 108) toward the platform 122 via an annulus or annular space located radially outward of the tubular 102. The annulus may be partially defined between the tubular 102 and the casing 114 that lines the wellbore 110 and may be partially defined between the tubular 102 and the drilling riser 120.

The drilling system 100 also includes a rotating control device (RCD) assembly 134. The RCD assembly 134 may be positioned at any suitable location within the drilling system 100, such as any suitable location between the wellbore 110 and the platform 122. For example, as shown, the RCD assembly 134 may be positioned between the BOP assembly 116 and the platform 122. In onshore or land-based applications, the RCD assembly 134 may be positioned along the drilling riser 120 between a surface above a subsurface formation and the platform 122. In subsea applications or other deepwater applications, the RCD assembly 134 may be positioned along the drilling riser 120 extending between, for example, a seabed location and the platform 122. The RCD assembly may be positioned along other types of equipment for use in other types of drilling applications.

The RCD assembly 134 may be configured for containing and isolating pressure in the wellbore 110. For example, the RCD assembly 134 may be configured to form a seal across and/or to block fluid flow through the annulus that surrounds the tubular 102. In various applications, the RCD assembly 134 may be configured to block the working fluid, cuttings, and/or other substances from the well 108 from flowing past the RCD assembly toward the platform 122. In operation, the tubular 102 may be rotated and/or moved along an axial axis A1 to enable the drill bit 128 to drill the well 108. The RCD assembly 134 may be controlled to provide a seal against the tubular 102 as the tubular 102 is rotated. In some embodiments, the RCD assembly 134 may act as a flow diverter and a pressure control equipment unit in the drilling system 100. In some embodiments, the BOP assembly 116 may additionally or alternatively act as a flow diverter and/or a pressure control equipment unit in the drilling system.

In some embodiments, the BOP assembly 116 and the RCD assembly 134 may at least partially form a managed pressure drilling (MPD) system of the drilling system 100.

The MPD system may regulate a pressure and a flow of working fluid within and/or around the tubular 102 such that the flow of the working fluid does not over pressurize the well (e.g., expand the well) and/or such that the well does not collapse under its own weight. The ability to manage the pressure and the flow of the working fluid enables use of the drilling system to drill in various locations, such as locations with relatively softer subterranean formations and/or sea beds.

During downhole operations, working fluid may be supplied via the drilling fluid system 132 through the tubular 102 (e.g., drill string) toward the bottom of the wellbore 110. For example, during a drilling operation, drilling fluid or drilling mud may be supplied through the tubular 102 toward the bottom of the wellbore 110 to help with the drilling operation, e.g., to cool the drill bit 128 and/or clear cuttings from the bottom of the wellbore. The working fluid may return through the annulus formed between the casing 114 and the tubular 102. The returning working fluid (which may include cuttings and/or other substances from the well 108) may exit the wellbore 110 and travel toward a surface via one or more flow paths, e.g., flow paths formed through the BOP assembly 116, the RCD assembly 134, the annulus between the tubular 102 and the riser 120, and/or other diverter, return and/or outlet lines. In some embodiments, an outlet line (not shown) may extend from the RCD assembly 134 to a portion of an MPD control system, which may include one or more MPD chokes and/or other valves (e.g., a choke manifold). Returning fluid may be routed through the outlet line from the RCD assembly 134, where the flow of the returning fluid may be controlled by one or more flow control equipment units (e.g., a choke) in the MPD control system. In some embodiments, the MPD control system may be activated to allow the flow of the returning fluid from the RCD assembly 134 through the outlet line. In some embodiments, when the MPD control system is not activated, returning fluid may be diverted from the annulus between the riser 120 and the tubular 102 and routed through a return line (not shown) to return, e.g., to the drilling fluid system 132, or through a return line on a bell nipper in a land rig (not shown).

In embodiments, returning fluid from a downhole operation may be returned to the surface of the downhole operation, at which point, the returning fluid may be passed through separators to remove cuttings from the working fluid, may go through controlled disassociation of gas hydrates, may go through solid control equipment to further remove fine solids, may be routed to one or more mud storage areas (mud pits), and/or may be returned as working fluid to the drilling fluid system.

Figure 2:
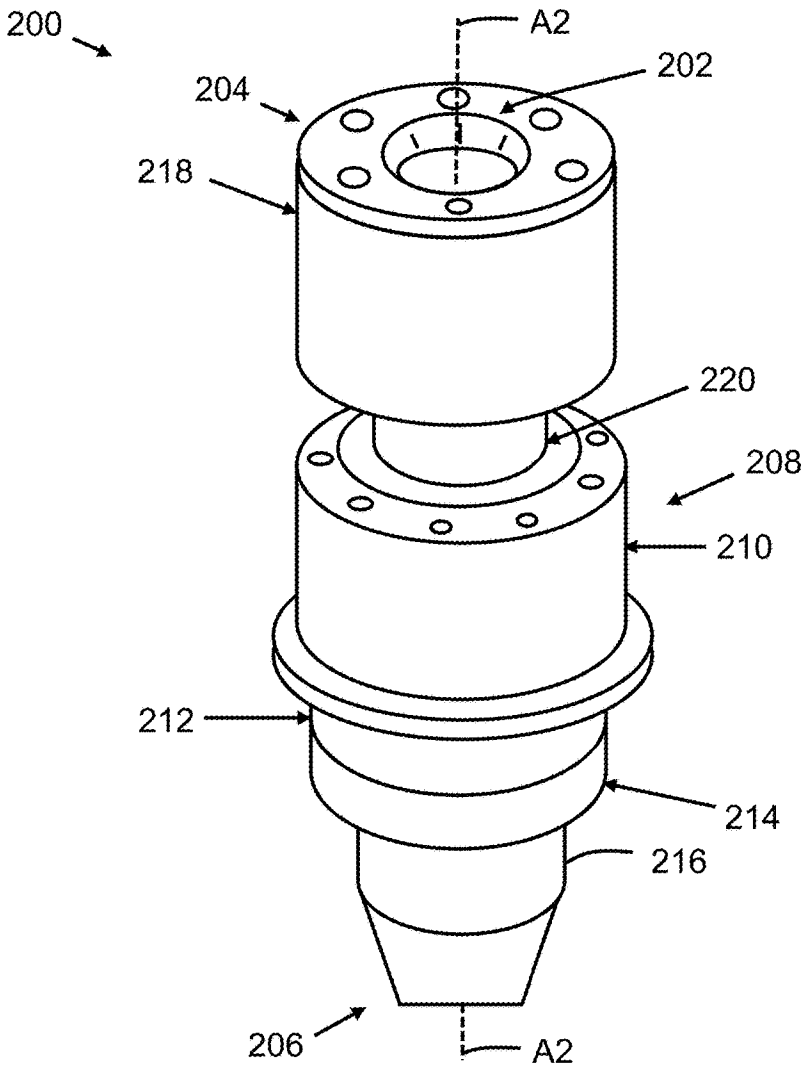
FIG. 2 is a schematic of a rotating control device (RCD) of the drilling system of FIG. 1.

FIG. 2 depicts an example of a rotating control device (RCD) 200 that may be used in the RCD assembly 134 of FIG. 1. The RCD 200 has a longitudinal axis A2 and defines an internal longitudinal passage 202 extending between a first end 204 and a second end 206 of the RCD 200. When the RCD 200 is installed in a drilling system, a tubular or drill string (e.g., the tubular 102 of the drilling system 100) can extend through the longitudinal passage 202 and the longitudinal axis A2 may be axially aligned with the axial axis A1 of FIG. 1. The first end 204, also referred to as an upper end or a top end, of the RCD 200 may face toward a platform (e.g., the platform 122 of FIG. 1). In some embodiments, the first end 204 of the RCD 200 may be directly or indirectly coupled to a drilling riser (e.g., the drilling riser 120 of FIG. 1). The second end 206, also referred to as a lower end or a bottom end, may face generally toward a well (e.g., the well 108 of FIG. 1). In some embodiments, the RCD 200 may be coupled to a BOP assembly (e.g., the BOP assembly 116 of FIG. 1) or other equipment of the drilling system proximate the second end 206. For example, a clamp or other suitable connection mechanism may engage an outer stationary housing portion 208 of the RCD 200 to secure the RCD 200 within the drilling system 100.

In the embodiments described herein, the longitudinal axis A2 of the RCD 200 may be oriented substantially vertically when the RCD 200 is in use. Directional terms such as "top," "bottom," "upper," "lower," "above," "below," and the like are used to describe spatial positions of the features and components of the RCD 200 relative to the vertically oriented axis A2. However, it is understood that the RCD 200 is not limited to a particular orientation and any directional terms are not limiting on the orientation. Additionally, directional terms such as "axial," "radial," "circumferential," and the like used to describe features and components of the RCD 200 are defined relative to the axis A2. For example, an "axial" direction is along or generally parallel to the axis A2. A "radial" direction is generally orthogonal to the axis A2. A "circumferential" direction is generally about the axis A2.

The outer stationary housing portion 208 may include a bearing housing 210, a rotary seal housing 212, and a pressure compensation housing 214. The stationary housing portion 208 may remain substantially stationary while the tubular rotates within the longitudinal passage 202. The RCD 200 also includes rotating components that co-rotate with the tubular about the axis A2. The rotating components include, for example, one or more sealing elements 216 (e.g., stripper elements or stripper rubbers) that each form a seal around the tubular extending through the longitudinal passage 202. The one or more sealing elements 216 may be secured to other rotating components of the RCD 200 such as, for example, an upper pot 218 positioned above the stationary housing portion 208 and a drive guide element 220 (e.g., a mandrel) extending through the stationary housing portion 208.

Figure 3:
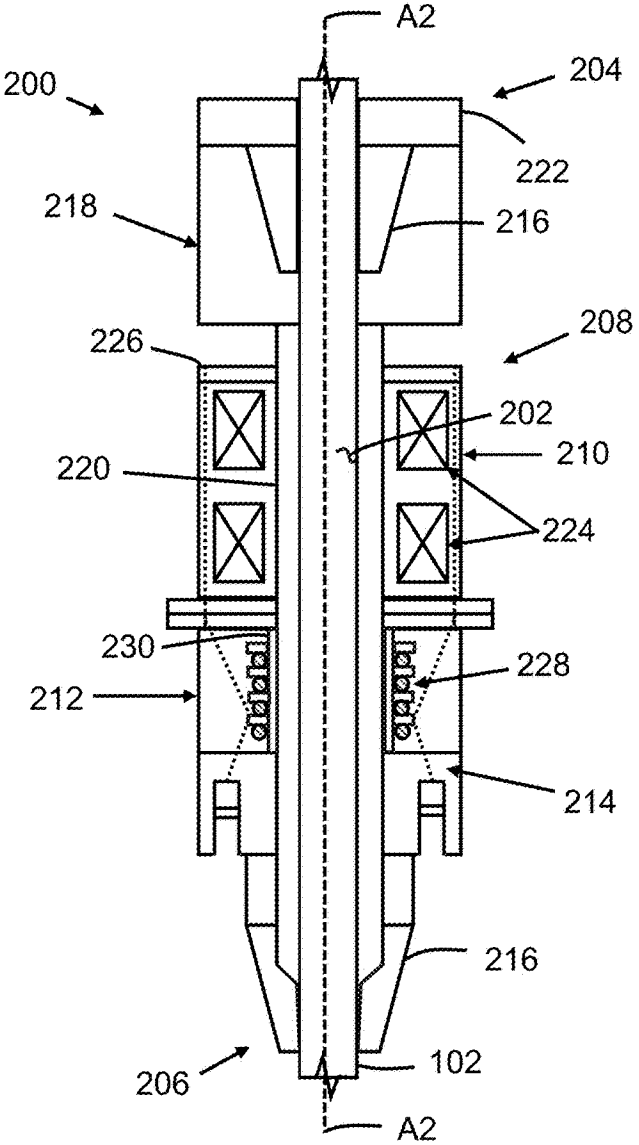
FIG. 3 is a schematic section of the RCD of FIG. 2, with a tubular extending therethrough.

Referring to FIG. 3, the RCD 200 includes two sealing elements 216 in this example. More or fewer sealing elements may be included. The sealing elements 216 include, for example, elastomeric seals, that are secured to the other rotating components of the RCD 200. Each of the sealing elements 216 is constructed with an opening that partially defines the longitudinal passage 202 extending through the RCD 200. The openings of the sealing elements 216 are suitably sized to receive the tubular 102 therethrough while remaining in sealing engagement with the tubular 102. The sealing elements 216 may be positioned respectively above and below the stationary housing portion 208 and, more particularly, above and below the bearing housing 210. The sealing elements 216 can freely rotate with the tubular 102 relative to the stationary housing portion 208 and suitably maintain a seal with the tubular 102 during rotation.

A first sealing element 216, also referred to as an upper sealing element or a top sealing element, is located within the upper pot 218. The first sealing element 216 may be secured within the upper pot 218 via a top flange 222 located at or proximate the first end 204 of the RCD 200. The top flange 222 may be positioned at a top of the upper pot 218. The top flange 222 may be secured to the upper pot 218 and the first sealing element 216 using any suitable attachment means, such as fasteners (e.g., bolts), threads, welding, bonding, or the like. A bottom of the upper pot 218 is secured to a top of the drive guide element 220. The upper pot 218 may be secured to the drive guide element 220 using any suitable attachment means, such as fasteners (e.g., bolts), threads, welding, bonding, or the like.

The drive guide element 220 extends through the stationary housing portion 208. The top of the drive guide element 220 extends above the stationary housing portion 208 and is secured to the bottom of the upper pot 218. A bottom of the drive guide element 220 extends below the stationary housing portion 208 and is secured to a second sealing element 216, also referred to as a lower sealing element or a bottom sealing element. The bottom sealing element 216 may be secured to the drive guide element 220 using any suitable attachment means, such as fasteners (e.g., bolts), threads, welding, bonding, or the like.

The drive guide element 220 may have a hollow cylindrical construction and may be formed of one or more segments. The drive guide element 220 may cooperatively define the longitudinal passage 202 with the openings of the sealing elements 216. The top flange 222 may include a central bore that defines an open end of the longitudinal passage 202 at the first end 204 of the RCD 200. The bottom sealing element 216 may define an open end of the longitudinal passage 202 at the second end 206 of the RCD 200. The tubular 102 extending through the longitudinal passage 202 may extend through each of the top flange 222, the upper pot 218, the sealing elements 216, the drive guide element 220, and the stationary housing portion 208. When the tubular 102 rotates within the RCD 200, the sealing elements 216 rotate with the tubular 102 about the axis A2 via the sealing engagement, which causes the upper pot 218 and the drive guide element 220 to rotate relative to the stationary housing portion 208 via the secured engagement between the first sealing element 216 and the upper pot 218 and between the second sealing element 216 and the drive guide element 220.

The bearing housing 210 circumscribes the drive guide element 220 proximate the top of the drive guide element 220. One or more bearing assemblies 224 are positioned in the bearing housing 210 for supporting the drive guide element 220 during rotation. The bearing assemblies 224 may include any suitable type of bearing assembly capable of supporting rotational and/or thrust loads. For example, the bearing assemblies 224 may include sets of roller bearings. In some embodiments, the bearing assemblies 224 may include roller bearings, ball bearings, journal bearings, tilt-pad bearings, diamond bearings, or combinations thereof.

The stationary housing portion 208 includes a top plate 226 secured to the bearing housing 210. The top plate 226 provides a top cover for the bearing housing 210 to limit ingress of material into the bearing housing that could negatively affect the performance of the bearing assemblies 224. The rotary seal housing 212 is positioned below the bearing housing 210 and includes rotary seals 228 that operate to limit ingress of material into the bearing housing 210.

The rotary seals 228 may be annular in shape and each surrounds and sealingly engages a seal sleeve 230 positioned between the rotary seals 228 and the drive guide element 220. The seal sleeve 230 may be secured to the drive guide element 220 such that the seal sleeve co-rotates with the drive guide element 220 relative to the rotary seals 228 and the rotary seal housing 212. The seal sleeve 230 may be secured to the drive guide element 220 using any suitable attachment means, such as keys, fasteners (e.g., bolts), threads, welding, bonding, or the like.

The rotary seals 228 may form a series of seals between the returning working fluid flowing through an annulus outward of the tubular 102 and the bearing housing 210. The rotary seals 228 may be arranged in an axial succession. The returning working fluid may exert pressure on the seals 228. The pressure experienced by each seal 228 may vary, e.g., decrease in the axial direction toward the bearing housing 210. A bottom rotary seal 228 in the arrangement may experience the greatest pressure and a top rotary seal 228 may experience the lowest pressure. In this example, the rotary seal housing 212 may include four rotary seals 228. More or fewer rotary seals can be included. In some embodiments, the rotary seal housing 212 may include at least three rotary seals 228.

Figure 4:
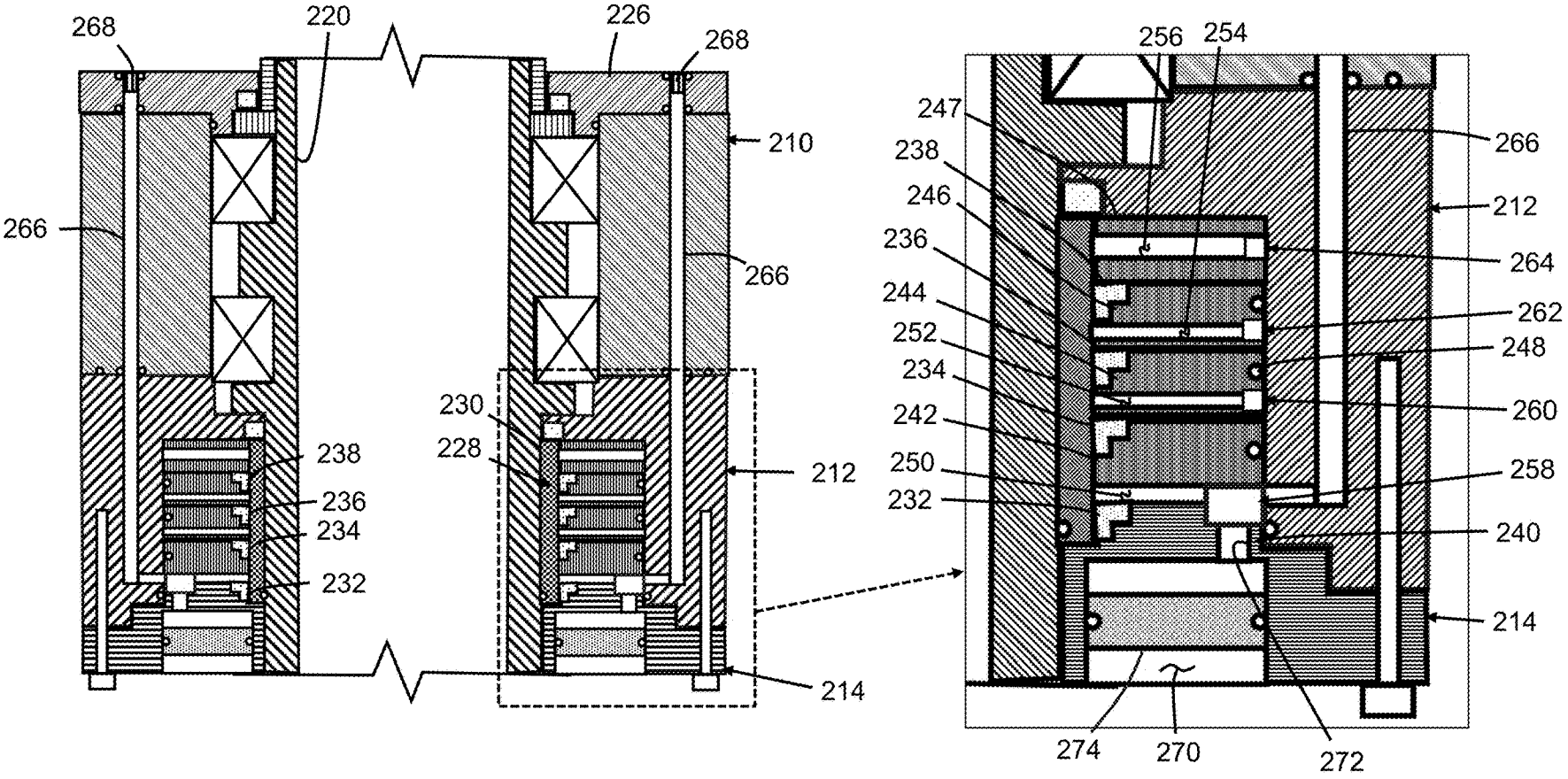
FIG. 4 is a magnified, schematic section of the RCD.

Referring to FIG. 4, the rotary seals 228 include a first rotary seal 232, a second rotary seal 234, a third rotary seal 236, and a fourth rotary seal 238. The rotary seals 232-238 are arranged in axial succession between the pressure compensation housing 214 and the bearing housing 210. The first rotary seal 232 defines the bottom rotary seal and is positioned proximate the pressure compensation housing 214. The fourth rotary seal 238 defines the top rotary seal and is positioned proximate the bearing housing 210. The second and third rotary seals 234, 236 are successively positioned between the first and fourth rotary seals 232, 238.

Each of the rotary seals 232-238 is supported in the rotary seal housing 212 by a respective seal retainer 240-246. Each retainer 240-246 may be annular or ring-shaped to complement a shape of the rotary seals 232-238. The retainers 240-246 may be separate or individual components. In some embodiments, some or all the retainers 240-246 may be integrated in a unitary structure (e.g., a unitary ring). In this embodiment, a first retainer 240 supporting the first rotary seal 232 may be integrated with the pressure compensation housing 214 and the other retainers 242-246 are separate or individual components. In some embodiments, the first retainer 240 supporting the first rotary seal 232 may also be a separate or individual component. The retainers 240-246 may each include a static seal 248 (e.g., O-rings or elastomeric seals) at an outer circumferential edge that forms a seal between the retainer and an inner radial surface of the rotary seal housing 212. In this way, the rotary seals 232-238 and the static seals 248 can cooperatively form seals at opposing radial ends of the retainers 240-246 between the seal sleeve 230 and the rotary seal housing 212.

Pressure exerted on the rotary seals 232-238 via the returning working fluid may be compensated for via a pressure compensating fluid (e.g., oil) contained in a volume behind each seal (i.e., axially downstream from each seal relative to the flow of the returning working fluid). The pressure compensating fluid behind each of the seals 232-238 may be distributed in sets of one or more passages 250-256 extending radially behind the respective seal 232-238 between the seal sleeve 230 and the rotary seal housing 212. For each rotary seal 232-238, the respective set of one or more passages 250-256 may include one passage or multiple passages, such as two, three, four, five, six, seven, eight, nine, ten, or more than ten passages. In embodiments where a set of multiple passages is provided behind any one or more of the rotary seals 232-238, the passages may be spaced circumferentially at regular or irregular intervals. For each rotary seal 232-238, the respective set of one or more passages 250-256 communicates with a respective annular chamber 258-264 extending circumferentially and positioned proximate the inner radial surface of the rotary seal housing 212. The annular chambers 258-264 can distribute the pressure compensating fluid across the respective set of one or more passages 250-256 and allow balancing the pressure of the pressure compensating fluid in the passages 250-256.

A first annular chamber 258 may be defined by a gap between a top of the first seal retainer 240 and a lower axial surface of the rotary seal housing 212. In some embodiments, the first annular chamber 258 may be defined by an annular recess in the outer circumferential edge of the second seal retainer 242 between the second seal retainer 242 and the inner radial surface of the rotary seal housing 212. A first set of radial passages 250 may be defined in the second seal retainer 242 proximate a bottom or lower axial surface of the second seal retainer 242. The first annular chamber 258 feeds the pressure compensating fluid into the first set of one or more passages 250 behind the first rotary seal 232. A second annular chamber 260 may be defined by an annular recess in the outer circumferential edge of the third seal retainer 244 between the third seal retainer 244 and the inner radial surface of the rotary seal housing 212. A second set of radial passages 252 may be defined in the third seal retainer 244 proximate a bottom or lower axial surface of the third seal retainer 244. The second annular chamber 260 feeds the pressure compensating fluid into the second set of one or more passages 252 behind the second rotary seal 234. A third annular chamber 262 may be defined by an annular recess in the outer circumferential edge of the fourth seal retainer 246 between the fourth seal retainer 246 and the inner radial surface of the rotary seal housing 212. A third set of radial passages 254 may be defined in the fourth seal retainer 246 proximate a bottom or lower axial surface of the fourth seal retainer 246. The third annular chamber 262 feeds the pressure compensating fluid into the third set of one or more passages 254 behind the third rotary seal 236. A fourth annular chamber 264 may be defined by an annular recess in an outer circumferential edge of an annular structure or insert 247 positioned behind the fourth rotary seal 238. The fourth annular chamber 264 is located between the outer circumferential edge of the annular structure 247 and the inner radial surface of the rotary seal housing 212. A fourth set of radial passages 256 may be defined in the annular structure 247 proximate a bottom or lower axial surface of the annular structure 247. The fourth annular chamber 264 feeds the pressure compensating fluid into the fourth set of one or more passages 256 behind the fourth rotary seal 238.

The first annular chamber 258 communicates with first feed lines 266 extending axially through the top plate 226, the bearing housing 210, and the rotary seal housing 212. One or more of the first feed lines 266 supply the pressure compensating fluid to the first annular chamber 258 and the first set of passages 250. Seals (e.g., bushings, O-rings, glands, etc.) may be positioned in the first feed lines 266 at or proximate the interface between the bearing housing 210 and the top plate 226 and at or proximate the interface between the bearing housing 210 and the rotary seal housing 212 to prevent the pressure compensating fluid from leaking. The first feed lines 266 are defined at discrete circumferential positions in the top plate 226, the bearing housing 210, and the rotary seal housing 212 such that the pressure compensating fluid can be independently supplied to the first annular chamber 258 and the first set of passages 250. Other feed lines, also referred to as fluid lines or pressure compensating fluid lines, that independently supply the pressure compensating fluid to the other annular chambers 260-264 and the other sets of passages 252-256 are described further below.

Any number of first feed lines 266 may be included. For example, there may be one first feed line or multiple first feed lines communicating with the first annular chamber 258. In some embodiments, two of the first feed lines 266 are included. In these embodiments, the first feed lines 266 can be spaced apart at 180° intervals, or another suitable interval. At least one (e.g., one, both, some, or all) of the first feed lines 266 may be used to supply the pressure compensating fluid to the first annular chamber 258. The pressure compensating fluid can enter the at least one first feed line 266 through at least one opening in the top plate 226 communicating with the first feed line 266. The openings in the top plate 226 communicating with the first feed lines 266 can be sealed using suitable sealing inserts or sealing fasteners 268, such as plugs, washers, screws, nuts, bolts, bushings, and combinations thereof. In some embodiments, the sealing insert 268 includes a threaded plug, e.g., a plug comprising NPT threads or an autoclave fitting. In some embodiments, the sealing fasteners are removable from the top plate 226 to allow the pressure compensating fluid to be fed into the first feed line(s) 266 through the opening which can subsequently be sealed using the sealing fasteners.

In some embodiments, only one or some of the first feed lines 266 may be used to supply the pressure compensating fluid. Another one or some of the first feed lines 266 may only provide a clearance or overflow line for excessive fluid volume. A first feed line providing only overflow clearance may be referred to as a first overflow line. The first feed lines and first overflow lines may also be referred to as first fluid lines or first pressure compensating fluid lines. A pressure relief (e.g., a pressure relief device or valve or a pressure test port) may be provided in the top plate 226 at the opening communicating with a first overflow line.

The first fluid lines 266 also communicate with an annular pressure compensating chamber 270 defined in the pressure compensation housing 214. The pressure compensation housing 214 includes one or more axial ports 272 extending between and allowing communication between the first annular chamber 258 and/or the first set of radial passages 250 and the annular pressure compensating chamber 270. As such, pressure compensating fluid supplied to the first annular chamber 258 and the first set of radial passages 250 via the first fluid line(s) 266 is also provided to the annular pressure compensating chamber 270 of the pressure compensation housing 214.

The pressure compensating fluid supplied to the first set of passages 250, the first annular chamber 258, and the annular pressure compensating chamber 270 may initially be unpressurized. The pressure compensation housing 214 also includes a piston ring 274 moveable in the annular pressure compensating chamber 270 for raising a pressure of the fluid in the first set of passages 250 and the first annular chamber 258. The piston ring 274 faces toward the well and is in the general flow path of the returning working fluid. The piston ring 274 moves upward (axially toward the first rotary seal 232) in the annular pressure compensating chamber 270 in response to pressure exerted on the piston ring 274 by the returning working fluid. Upward movement of the piston ring 274 reduces the available volume for the pressure compensating fluid in the first set of passages 250, the first annular chamber 258, and the annular pressure compensating chamber 270, which raises the pressure of the pressure compensating fluid. The piston ring 274 causes the pressure to increase until a pressure differential between the returning working fluid and the pressure compensating fluid in the annular chamber 258 and the first set of passages 250 is negligible or approximately zero. Such balancing of pressure facilitates limiting or preventing fluid leaks at the first rotary seal 232 by reducing or eliminating the pressure differential experienced across the first rotary seal.

Figure 5:
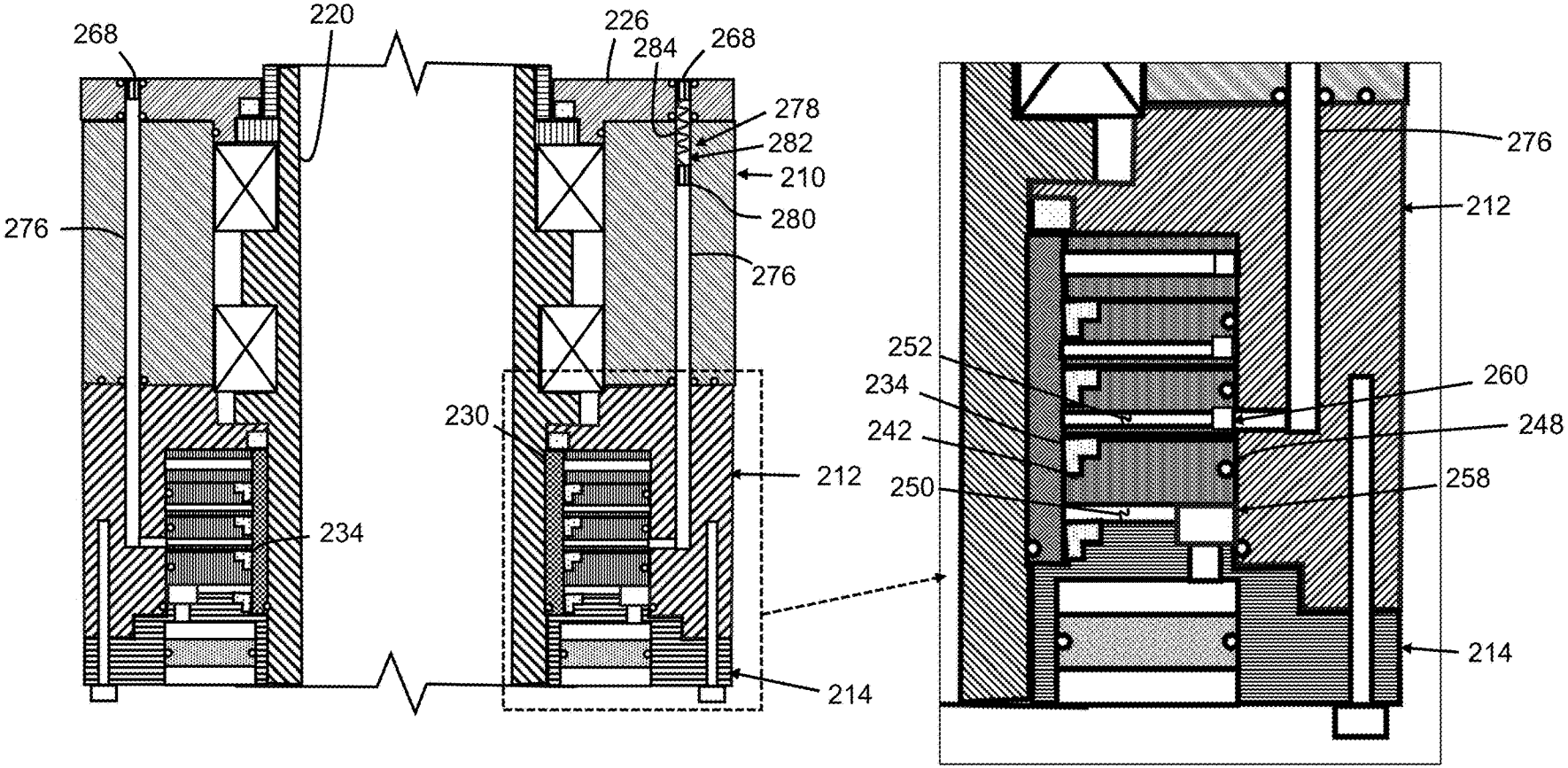
FIG. 5 is another magnified, schematic section of the RCD, rotated 36° about a longitudinal axis relative to the view of FIG. 4.

Referring to FIG. 5, the second annular chamber 260 and the second set of passages 252 are sealed from the first annular chamber 258 and the first set of passages 250 via the second rotary seal 234 and the static seal 248 of the second seal retainer 242. Pressure compensating fluid can be supplied to the second annular chamber 260 and the second set of passages 252 via one or more second fluid lines 276 that are isolated from the first feed lines 266 (FIG. 4). The second fluid lines can also be referred to as second feed lines or second pressure compensating fluid lines. Like the first fluid lines, the second fluid lines 276 extend axially through the top plate 226, the bearing housing 210, and the rotary seal housing 212. Seals (e.g., bushings, O-rings, glands, etc.) may be positioned in the second fluid lines 276 at or proximate the interface between the bearing housing 210 and the top plate 226 and at or proximate the interface between the bearing housing 210 and the rotary seal housing 212 to prevent the pressure compensating fluid from leaking. The second fluid lines 276 are defined at discrete circumferential positions in the top plate 226, the bearing housing 210, and the rotary seal housing 212. The second fluid lines 276 are at different positions from the first fluid lines 266 and the other fluid lines such that the pressure compensating fluid can be supplied to the second annular chamber 260 and the second set of passages 252 independently from the fluid supplied to the other annular chambers 258, 262, 264. Other fluid lines that independently supply the pressure compensating fluid to the other annular chambers 262 and 264 and the other sets of passages 254 and 256 are described further below.

Any number of second fluid lines 276 may be included. For example, there may be one second fluid line or multiple second fluid lines communicating with the second annular chamber 260. In some embodiments, two of the second fluid lines 276 are included. In these embodiments, the second fluid lines 276 can be spaced apart at 180° intervals, or another suitable interval. At least one (e.g., one, both, some, or all) of the second fluid lines 276 may be used to supply the pressure compensating fluid to the second annular chamber 260. The pressure compensating fluid can enter the at least one second fluid line 276 through at least one opening in the top plate 226 communicating with the second fluid line 276. The openings in the top plate 226 communicating with the second fluid lines 276 can be sealed using the sealing inserts or sealing fasteners 268, such as plugs, washers, screws, nuts, bolts, bushings, and combinations thereof. In some embodiments, the sealing fasteners are removable from the top plate 226 to allow the pressure compensating fluid to be fed into the second fluid line(s) 276 through the opening which can subsequently be sealed using the sealing fasteners.

In some embodiments, only one or some of the second fluid lines 276 may be used to supply the pressure compensating fluid. Another one or some of the second fluid lines 276 may be overflow line(s) that provide a clearance for excessive fluid volume. A pressure relief (e.g., a pressure relief device or valve or a pressure test port) may be provided in the top plate 226 at the opening communicating with a second fluid line 276 operating as an overflow line.

The pressure compensating fluid supplied to the second set of passages 252 and the second annular chamber 260 may initially be un-pressurized. As the pressure compensating fluid in the first set of passages 250 and the first annular chamber 258 pressurizes in response to movement of the piston ring 274 as described above with reference to FIG. 4, a pressure differential across the second rotary seal 234 may increase. The rising pressure differential across the second rotary seal 234 creates the risk of fluid leaking across the second rotary seal 234. One or more second fluid lines 276 (e.g., the second fluid line(s) 276 operating as overflow line(s)) may include a variable pressure compensating device 278 positioned therein for gradually increasing the pressure of the pressure compensating fluid in the second set of passages 252 and the second annular chamber 260 when the second rotary seal 234 leaks. The variable pressure compensating device 278 operates to limit the available clearance for excessive fluid volume entering the second set of passages 252 when the second rotary seal 234 leaks. During a leak across the second rotary seal 234, the variable pressure compensating device 278 causes gradual build up of pressure in the pressure compensating fluid in the second set of passages 252, which reduces the pressure differential across the second rotary seal 234. As the leak continues, the pressure differential across the second rotary seal 234 approaches zero or reduces to such an extent that the leak is slowed or stops completely.

The variable pressure compensating device 278 may be at any suitable location in the second overflow line 276. For example, the variable pressure compensating device 278 may be located proximate the top plate 226, e.g., at or proximate the interface between the bearing housing 210 and the top plate 226. In some embodiments, the variable pressure compensating device 278 may include and/or cooperate with the sealing fastener or sealing insert 268 for the second overflow line 276. In some embodiments, the variable pressure compensating device 278 may be located at or proximate the interface between the bearing housing 210 and the rotary seal housing 212.

The variable pressure compensating device 278 may include a moveable member (e.g., a piston) 280 positioned within a chamber 282 of the device. The chamber 282 is in fluid communication with the second overflow line 276 such that pressure compensating fluid is received in the chamber 282. In some embodiments, the chamber 282 may include or define a portion of the second overflow line 276. During a leak across the seal, additional pressure compensating fluid flows into the chamber 282 causing the moveable member 280 to move in the chamber 282. A biasing means 284 (e.g., a spring) compresses in response to movement of the member 280 in the chamber 282, eventually stopping further movement of the member when fully compressed or when the pressure exerted on the moveable member 280 is insufficient to further compress the biasing means. At this stage, the pressure of the pressure compensating fluid in the second overflow line 276 builds as more fluid leaks across the second rotary seal 234. The build up of pressure in the second overflow line 276 also causes the pressure in the second set of passages 252 and the second annular chamber 260 to build until the pressure differential is sufficiently low to slow or stop the leak.

In some embodiments, the biasing means 284 may be operably coupled between the sealing insert or sealing fastener 268 and the moveable member 280. The biasing means 284 (e.g., spring) may be compressible and expandable in the chamber 282 such that the moveable member 280 can move toward and away from the sealing insert or sealing fastener 268. The sealing insert or sealing fastener 268 may be fixedly installed in the top plate 226 such that the sealing insert or sealing fastener 268 does not substantially move in response to movement of the moveable member 280 and compression or expansion of the biasing means 284.

Figure 6:
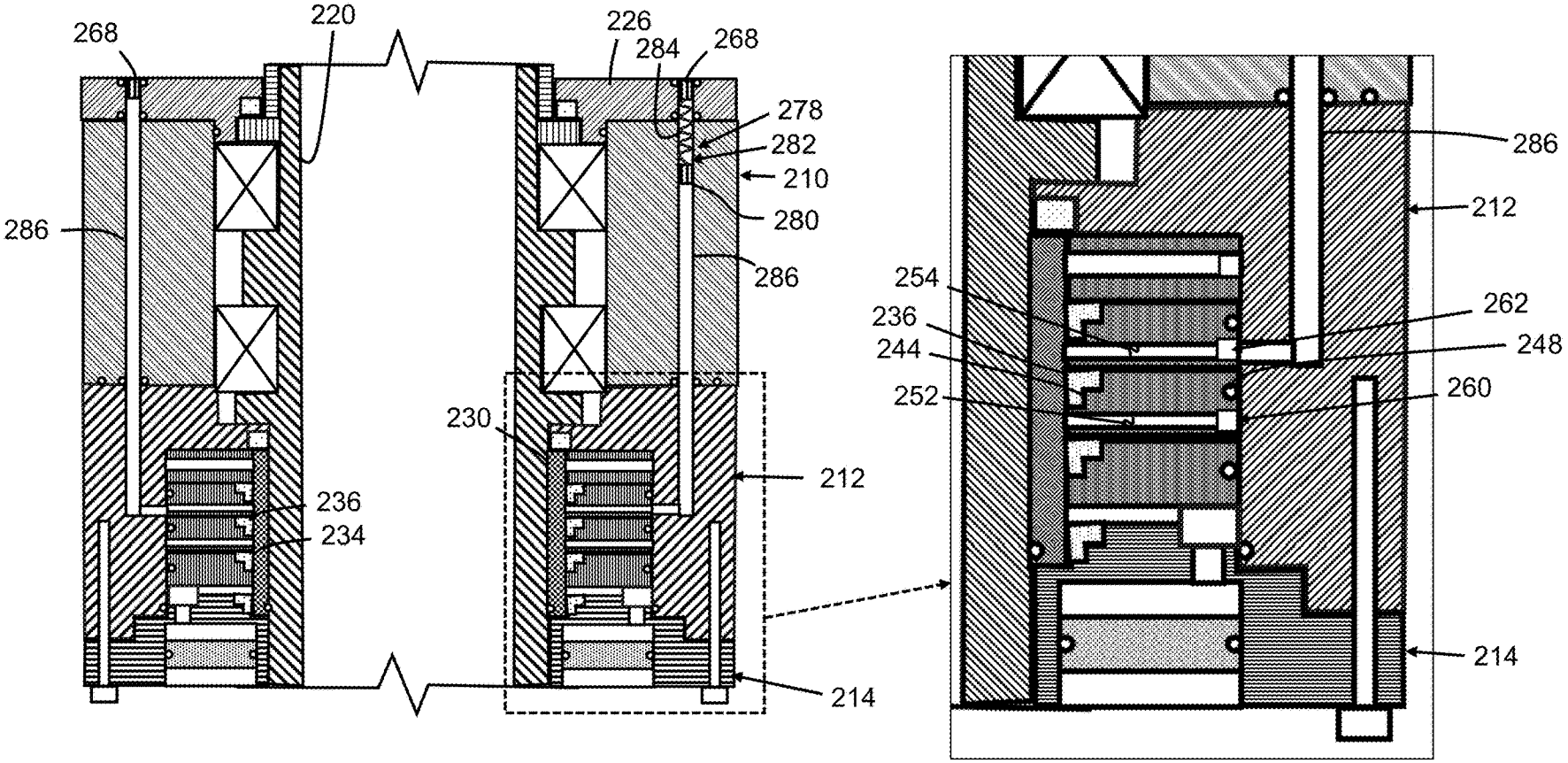
FIG. 6 is another magnified, schematic section of the RCD, rotated 36° about the longitudinal axis relative to the view of FIG. 5.

Referring to FIG. 6, the third annular chamber 262 and the third set of passages 254 are sealed from the second annular chamber 260 and the second set of passages 252 via the third rotary seal 236 and the static seal 248 of the third seal retainer 244. Pressure compensating fluid can be supplied to the third annular chamber 262 and the third set of passages 254 via third fluid lines 286 that are isolated from the first fluid lines 266 (FIG. 4) and the second fluid lines 276 (FIG. 5). The third fluid lines can also be referred to as third feed lines or third pressure compensating fluid lines. Like the first and second fluid lines, the third fluid lines 286 extend axially through the top plate 226, the bearing housing 210, and the rotary seal housing 212. Seals (e.g., bushings, O-rings, glands, etc.) may be positioned in the third fluid lines 286 at or proximate the interface between the bearing housing 210 and the top plate 226 and at or proximate the interface between the bearing housing 210 and the rotary seal housing 212 to prevent the pressure compensating fluid from leaking. The third fluid lines 286 are defined at discrete circumferential positions in the top plate 226, the bearing housing 210, and the rotary seal housing 212. The third fluid lines 286 are at different positions from the first and second fluid lines and the other fluid lines such that the pressure compensating fluid can be supplied to the third annular chamber 262 and the third set of passages 254 independently from the fluid supplied to the other annular chambers 258, 260, 264. Other fluid lines that independently supply the pressure compensating fluid to the fourth annular chamber 264 and the fourth set of passages 256 are described further below.

Any number of third fluid lines 286 may be included. For example, there may be one third fluid line or multiple third fluid lines communicating with the third annular chamber 262. In some embodiments, two of the third fluid lines 286 are included. In these embodiments, the third fluid lines 286 can be spaced apart at 180° intervals, or another suitable interval. At least one (e.g., one, both, some, or all) of the third fluid lines 286 may be used to supply the pressure compensating fluid to the third annular chamber 262. The pressure compensating fluid can enter the at least one third fluid line 286 through at least one opening in the top plate 226 communicating with the third fluid line 286. The openings in the top plate 226 communicating with the third fluid lines 286 can be sealed using the sealing inserts or sealing fasteners 268, such as plugs, washers, screws, nuts, bolts, bushings, and combinations thereof. In some embodiments, the sealing fasteners are removable from the top plate 226 to allow the pressure compensating fluid to be fed into the third fluid line(s) 286 through the opening, which can subsequently be sealed using the sealing fasteners.

In some embodiments, only one or some of the third fluid lines 286 may be used to supply the pressure compensating fluid. Another one or some of the third fluid lines 286 may be overflow line(s) that provide a clearance for excessive fluid volume. A pressure relief (e.g., a pressure relief device or valve or a pressure test port) may be provided in the top plate 226 at the opening communicating with a third fluid line 286 operating as an overflow line.

The pressure compensating fluid supplied to the third set of passages 254 and the third annular chamber 262 may initially be un-pressurized. As the pressure compensating fluid in the second set of passages 252 and the second annular chamber 260 pressurizes in response to a fluid leak across the second rotary seal 234 as described above with reference to FIG. 5, a pressure differential across the third rotary seal 236 may increase. The rising pressure differential across the third rotary seal 236 creates the risk of fluid leaking across the third rotary seal 236. One or more third fluid lines 286 (e.g., the third fluid line(s) operating as overflow line(s)) may include the variable pressure compensating device 278 positioned therein for gradually increasing the pressure of the pressure compensating fluid in the third set of passages 254 and the third annular chamber 262 when the third rotary seal 236 leaks.

The variable pressure compensating device 278 may be at any suitable location in the third overflow line 286. For example, the variable pressure compensating device 278 may be located proximate the top plate 226, e.g., at or proximate the interface between the bearing housing 210 and the top plate 226. In some embodiments, the variable pressure compensating device 278 may include and/or cooperate with the sealing fastener or sealing insert 268 for the third overflow line 286. In some embodiments, the variable pressure compensating device 278 may be located at or proximate the interface between the bearing housing 210 and the rotary seal housing 212.

The variable pressure compensating device 278 may limit the available clearance for excessive fluid volume entering the third set of passages 254 when the third rotary seal 236 leaks. The variable pressure compensating device 278 may operate as discussed above using the moveable member 280 (e.g., a piston) that moves in the chamber 282 in response to the pressure compensating fluid and the biasing means 284 (e.g., a spring) that controls movement of the moveable member 280 to allow the pressure compensating fluid to build pressure. For the variable pressure compensating device 278 positioned in the third overflow line 286, in some embodiments, the chamber 282 may include or define a portion of the third overflow line 286. During a leak across the third rotary seal 236, the variable pressure compensating device 278 causes gradual build up of pressure in the pressure compensating fluid in the third set of passages 254 which reduces the pressure differential across the third rotary seal 236. As the leak continues, the pressure differential across the third rotary seal 236 approaches zero or reduces to such an extent that the leak is slowed or stops completely.

Figure 7:
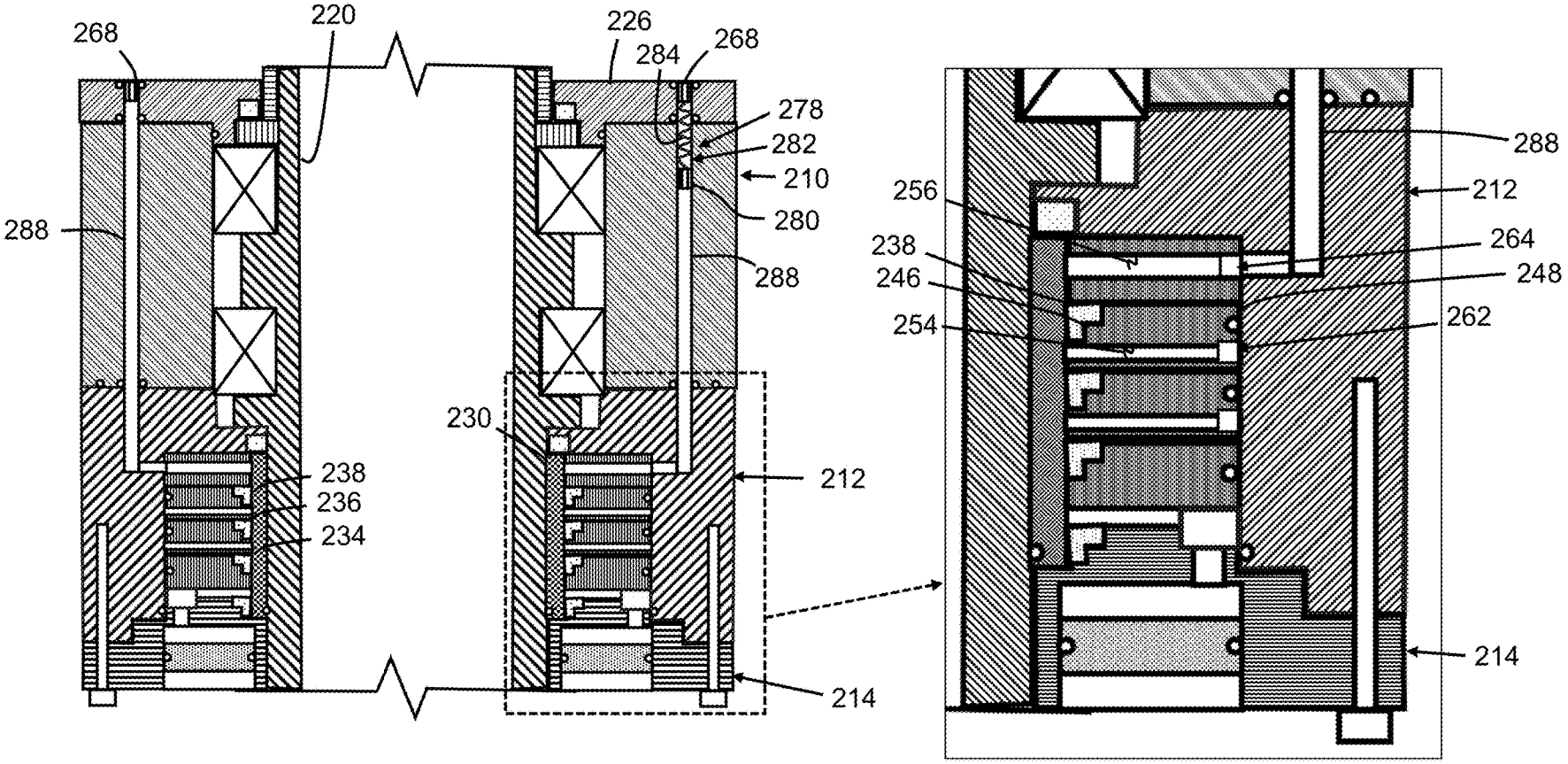
FIG. 7 is another magnified, schematic section of the RCD, rotated 36° about the longitudinal axis relative to the view of FIG. 6.

Referring to FIG. 7, the fourth annular chamber 264 and the fourth set of passages 256 are sealed from the third annular chamber 262 and the third set of passages 254 via the fourth rotary seal 238 and the static seal 248 of the fourth seal retainer 246. Pressure compensating fluid can be supplied to the fourth annular chamber 264 and the fourth set of passages 256 via fourth fluid lines 288 that are isolated from the first fluid lines 266 (FIG. 4), the second fluid lines 276 (FIG. 5), and the third fluid lines 286 (FIG. 6). The fourth fluid lines can also be referred to as fourth feed lines or fourth pressure compensating fluid lines. Like the first, second, and third fluid lines, the fourth fluid lines 288 extend axially through the top plate 226, the bearing housing 210, and the rotary seal housing 212. Seals (e.g., bushings, O-rings, glands, etc.) may be positioned in the fourth fluid lines 288 at or proximate the interface between the bearing housing 210 and the top plate 226 and at or proximate the interface between the bearing housing 210 and the rotary seal housing 212 to prevent the pressure compensating fluid from leaking. The fourth fluid lines 288 are defined at discrete circumferential positions in the top plate 226, the bearing housing 210, and the rotary seal housing 212. The fourth fluid lines 288 are at different positions from the first, second, and third fluid lines such that the pressure compensating fluid can be supplied to the fourth annular chamber 264 and the fourth set of passages 256 independent from the fluid supplied to the other annular chambers 258, 260, 262.

Any number of fourth fluid lines 288 may be included. For example, there may be one fourth fluid line or multiple fourth fluid lines communicating with the fourth annular chamber 264. In some embodiments, two of the fourth fluid lines 288 are included. In these embodiments, the fourth fluid lines 288 can be spaced apart at 180° intervals, or another suitable interval. At least one (e.g., one, both, some, or all) of the fourth fluid lines 288 may be used to supply the pressure compensating fluid to the fourth annular chamber 264. The pressure compensating fluid can enter the at least one fourth fluid line 288 through at least one opening in the top plate 226 communicating with the fourth fluid line 288. The openings in the top plate 226 communicating with the fourth fluid lines 288 can be sealed using the sealing inserts or sealing fasteners 268, such as plugs, washers, screws, nuts, bolts, bushings, and combinations thereof. In some embodiments, the sealing fasteners are removable from the top plate 226 to allow the pressure compensating fluid to be fed into the fourth fluid line(s) 288 through the opening which can subsequently be sealed using the sealing fasteners.

In some embodiments, only one or some of the fourth fluid lines 288 may be used to supply the pressure compensating fluid. Another one or some of the fourth fluid lines 288 may be overflow line(s) that provide a clearance for excessive fluid volume. A pressure relief (e.g., a pressure relief device or valve or a pressure test port) may be provided in the top plate 226 at the opening communicating with a fourth fluid line 288 operating as an overflow line.

The pressure compensating fluid supplied to the fourth set of passages 256 and the fourth annular chamber 264 may initially be un-pressurized. As the pressure compensating fluid in the third set of passages 254 and the third annular chamber 262 pressurizes in response to a fluid leak across the third rotary seal 236 as described above with reference to FIG. 6, a pressure differential across the fourth rotary seal 238 may increase. The rising pressure differential across the fourth rotary seal 238 creates the risk of fluid leaking across the fourth rotary seal 238. One or more fourth fluid lines 288 (e.g., the fourth fluid line(s) operating as overflow line(s)) may include the variable pressure compensating device 278 positioned therein for gradually increasing the pressure of the pressure compensating fluid in the fourth set of passages 256 and the fourth annular chamber 264 when the fourth rotary seal 238 leaks.

The variable pressure compensating device 278 may be at any suitable location in the fourth overflow line 288. For example, the variable pressure compensating device 278 may be located proximate the top plate 226, e.g., at or proximate the interface between the bearing housing 210 and the top plate 226. In some embodiments, the variable pressure compensating device 278 may include and/or cooperate with the sealing fastener or sealing insert 268 for the fourth overflow line 288. In some embodiments, the variable pressure compensating device 278 may be located at or proximate the interface between the bearing housing 210 and the rotary seal housing 212.

The variable pressure compensating device 278 may limit the available clearance for excessive fluid volume entering the fourth set of passages 256 when the fourth rotary seal 238 leaks. The variable pressure compensating device 278 may operate as discussed above using the moveable member 280 (e.g., a piston) that moves in the chamber 282 in response to the pressure compensating fluid and the biasing means 284 (e.g., a spring) that controls movement of the moveable member 280 to allow the pressure compensating fluid to build pressure. For the variable pressure compensating device 278 positioned in the fourth overflow line 288, in some embodiments, the chamber 282 may include or define a portion of the fourth overflow line 288. During a leak across the fourth rotary seal 238, the variable pressure compensating device 278 causes gradual build up of pressure in the pressure compensating fluid in the fourth set of passages 256, which reduces the pressure differential across the fourth rotary seal 238. As the leak continues, the pressure differential across the fourth rotary seal 238 approaches zero or reduces to such an extent that the leak is slowed or stops completely.

The variable pressure compensating devices 278 described above for FIGS. 5-7 enable the RCD 200 to implement a cascading or staged variable pressure compensating mechanism for controlling pressure differential across the rotary seals 228 in response to fluid leaks. The variable pressure compensating devices 278 also operate in conjunction with the pressure compensating housing 214 that controls pressure differential across the first rotary seal 232 in response to external pressure of the returning working fluid. It is understood that the variable pressure compensating devices 278 can be used for gradually reducing the pressure differential across one, some, or all the rotary seals 234-238 downstream from the first rotary seal 232. For example, a variable pressure compensating device 278 may be provided in one or more second fluid lines 276, one or more third fluid lines 286, and/or one or more fourth fluid lines 288. In some embodiments, a variable pressure compensating device 278 may be provided in one or more first fluid lines 266.

Advantageously, the variable pressure compensating devices 278 enable the RCD 200 to employ internal pressure compensation using the pressure compensating fluid that is contained within internal volumes of the RCD (e.g., within the fluid lines). In this way, an external pressure source for compensating pressure across the rotary seals 228 may be omitted. In some embodiments, the pressure compensating fluid may be the same or similar fluid (e.g., oil) as the bearing fluid supplied to the bearing housing 210.

Figure 8:
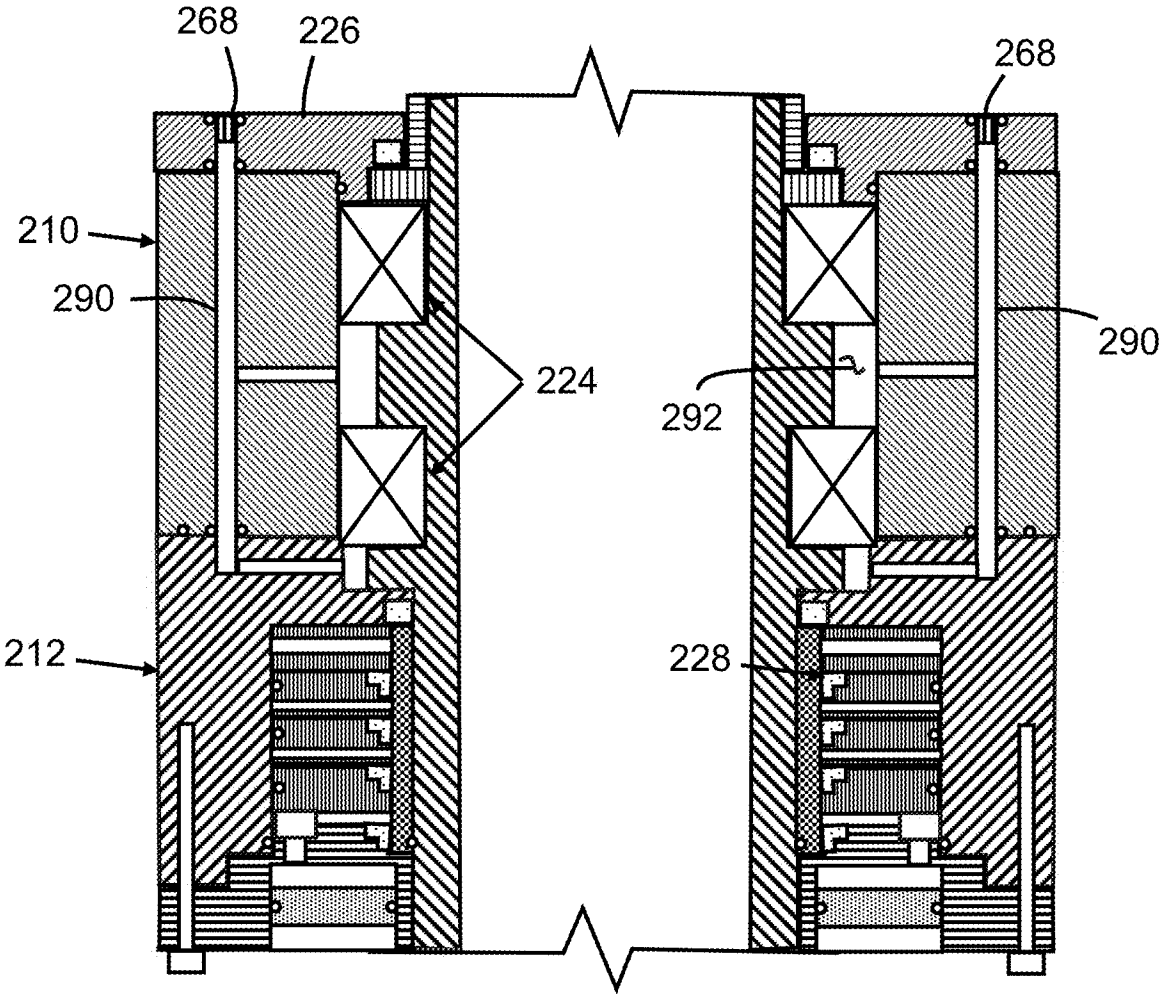
FIG. 8 is another magnified, schematic section of the RCD, rotated 36° about the longitudinal axis relative to the view of FIG. 7.

Referring to FIG. 8, the bearing fluid may be supplied to an internal volume 292 of the bearing housing 210 via bearing fluid lines 290. The bearing fluid may be used to lubricate or otherwise improve the performance of the bearing assemblies 224. The bearing fluid lines 290 are isolated from the first fluid lines 266 (FIG. 4), the second fluid lines 276 (FIG. 5), the third fluid lines 286 (FIG. 6), and the fourth fluid lines 288 (FIG. 7). The bearing fluid lines can also be referred to as bearing feed lines or bearing lines. The bearing fluid lines 290 extend axially through the top plate 226 and the bearing housing 210 to communicate with the internal volume 292 of the bearing housing 210. In some embodiments, the internal volume 292 of the bearing housing 210 may communicate with an opening in the rotary seal housing 212 above the rotary seals 228 and the bearing fluid lines 290 may partially extend through a top portion of the rotary seal housing 212. Seals (e.g., bushings, O-rings, glands, etc.) may be positioned in the bearing fluid lines 290 at or proximate the interface between the bearing housing 210 and the top plate 226 and at or proximate the interface between the bearing housing 210 and the rotary seal housing 212 to prevent the pressure compensating fluid from leaking. The bearing fluid lines 290 are defined at discrete circumferential positions in the top plate 226, the bearing housing 210, and the rotary seal housing 212. The bearing fluid lines 290 are at different positions from the first, second, third, and fourth fluid lines such that the bearing fluid can be supplied to the bearing housing 210 independent from the pressure compensating fluid supplied to the annular chambers 258, 260, 262, 264.

Any number of bearing fluid lines 290 may be included. For example, there may be one bearing fluid line or multiple bearing fluid lines communicating with the internal volume 292 of the bearing housing 210. In some embodiments, two of the bearing fluid lines 290 are included. In these embodiments, the bearing fluid lines 290 can be spaced apart at 180° intervals, or another suitable interval. At least one (e.g., one, both, some, or all) of the bearing fluid lines 290 may be used to supply the bearing fluid to the internal volume 292 of the bearing housing 210. The bearing fluid can enter the at least one bearing fluid line 290 through at least one opening in the top plate 226 communicating with the bearing fluid line 290. The openings in the top plate 226 communicating with the bearing fluid lines 290 can be sealed using the sealing inserts or sealing fasteners 268, such as plugs, washers, screws, nuts, bolts, bushings, and combinations thereof. In some embodiments, the sealing fasteners are removable from the top plate 226 to allow the bearing fluid to be fed into the bearing fluid line(s) 290 through the opening, which can subsequently be sealed using the sealing fasteners.

In some embodiments, only one or some of the bearing fluid lines 290 may be used to supply the bearing fluid. Another one or some of the bearing fluid lines 290 may be overflow line(s) that provide a clearance for excessive fluid volume. A pressure relief (e.g., a pressure relief device or valve or a pressure test port) may be provided in the top plate 226 at the opening communicating with a bearing fluid line 290 operating as an overflow line.

In some embodiments, each of the fluid lines 266, 276, 286, 288, 290 includes a set of two fluid lines circumferentially spaced at 180° intervals from one another. The fluid lines 266, 276, 286, 288, 290 may be circumferentially spaced apart from adjacent other fluid lines 266, 276, 286, 288, 290 at 36° intervals. For example, a first fluid line 266 may be circumferentially spaced 36° from an adjacent second fluid line 276, which is circumferentially spaced 36° from an adjacent third fluid line 286, and so on.

Figure 9:
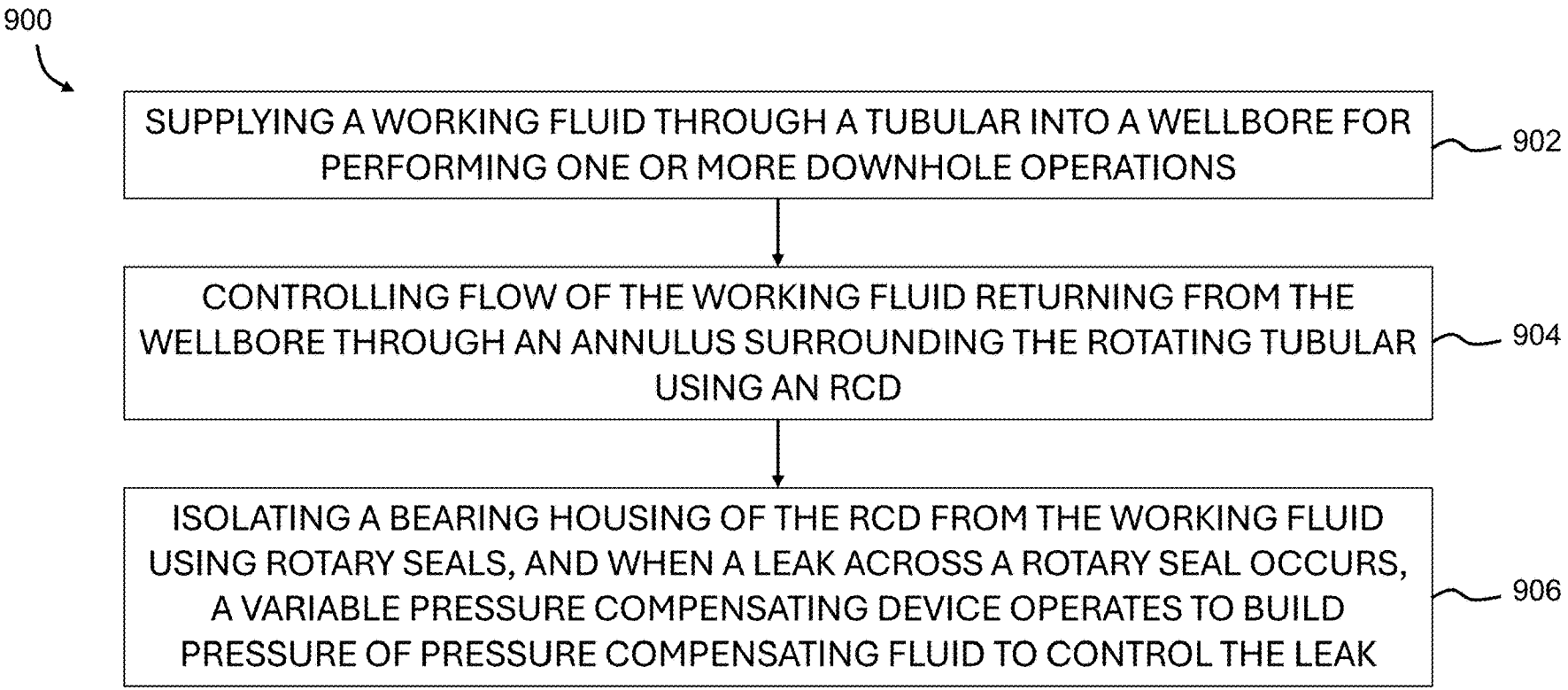
FIG. 9 is an example method of operating a drilling system.

Referring to FIG. 9, a method 900 of operating a drilling system (e.g., the drilling system 100 of FIG. 1) is shown. The method includes supplying 902 a working fluid (e.g., a drilling fluid or drilling mud) through a tubular (e.g., the tubular 102) into a wellbore (e.g., the wellbore 110) for performing one or more downhole operations using the tubular. The downhole operations may include, for example, drilling, tripping (tripping in or out), reaming, wiper tripping, and/or another downhole operation that utilizes operation of the tubular (e.g., via translation or rotation of the tubular). The method 900 also includes controlling 904 flow of the working fluid returning from the wellbore 110 through an annulus surrounding the tubular 102 using the RCD 200 described above with reference to FIGS. 2-8. The method 900 also includes isolating 906 the bearing housing 210 from the flow of the working fluid returning from the wellbore 110 using the rotary seals 228 of the RCD 200. When a leak across at least one of the rotary seals 228 (e.g., the second rotary seal 234, the third rotary seal 236, and/or the fourth rotary seal 238) occurs, the variable pressure compensating device 278 operates to build pressure of the pressure compensating fluid in the respective set of radial passages (e.g., the second set of radial passages 252, the third set of radial passages 254, and/or the fourth set of radial passages 256) to control the leak.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, references to "one embodiment" or "an embodiment" of the present disclosure are not intended to be interpreted as excluding the existence of additional embodiments that also incorporate the recited features. The terms "upstream" and "downstream" are understood relatively to the normal direction of circulation of a fluid in a conduit.

All documents described herein are incorporated by reference herein, including any priority documents and or testing procedures to the extent they are not inconsistent with this text. As is apparent from the foregoing general description and the specific embodiments, while forms of the present disclosure have been illustrated and described, various modifications can be made without departing from the spirit and scope of the present disclosure. Accordingly, it is not intended that the present disclosure be limited thereby.

As used herein, the term "comprising" is considered synonymous with the term "including" for purposes of United States law. Whenever a composition, an element or a group of elements is preceded with the transitional phrase "comprising," it is understood that the transitional phrases "consisting essentially of," "consisting of," "selected from the group consisting of," or "is" can additionally or alternatively precede the recitation of the composition, element, or elements and vice versa.

The specific embodiments described herein have been illustrated by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for (perform)ing (a function) . . . " or "step for (perform)ing (a function) . . . ", it is intended that such elements are to be interpreted under 35 U.S.C. 112(f). However, for any claims containing elements designated in any other manner, it is intended that such elements are not to be interpreted under 35 U.S.C. 112(f).

While the present disclosure has been described with respect to a number of embodiments and examples, those skilled in the art, having benefit of this disclosure, will appreciate that other embodiments can be devised which do not depart from the scope and spirit of the present disclosure.

What is claimed is:

1. A rotating control device (RCD) defining a longitudinal passage through which a tubular extends in an axial direction, the RCD comprising:

a drive guide element surrounding the tubular and co-rotating with the tubular;

a bearing housing comprising at least one bearing assembly for rotatably supporting the drive guide element;

a rotary seal housing comprising a plurality of rotary seals surrounding the drive guide element and configured to limit ingress of a working fluid flowing around the tubular into the bearing housing, the plurality of rotary seals arranged in the axial direction, the plurality of rotary seals comprising a first rotary seal and a second rotary seal positioned axially downstream from the first rotary seal;

a plurality of fluid lines in communication with a plurality of radial passages containing a pressure compensating fluid for controlling a pressure differential across the plurality of rotary seals, the plurality of fluid lines comprising a first fluid line and a second fluid line, the plurality of radial passages comprising a first radial passage in communication with the first fluid line and a second radial passage in communication with the second fluid line;

a pressure compensating piston positioned axially upstream from the first rotary seal, the pressure compensating piston configured to build pressure of the pressure compensating fluid in the first radial passage in response to flow of the working fluid to control the pressure differential across the first rotary seal; and a variable pressure compensating device positioned in the second fluid line axially downstream from the second rotary seal, wherein the variable pressure compensating device is configured to build pressure of the pressure compensating fluid in the second radial passage in response to a leak across the second rotary seal to control the pressure differential across the second rotary seal.

2. The RCD of claim 1, wherein the variable pressure compensating device comprises a moveable member positioned in a chamber and moveable therein in response to excessive pressure compensating fluid in the second radial passage from the leak across the second rotary seal.

3. The RCD of claim 2, wherein the moveable member is a piston operably connected with a biasing means that is configured to control movement of the piston in the chamber.

4. The RCD of claim 1, wherein the pressure compensating piston is positioned in a pressure compensating chamber and moveable therein in response to the flow of the working fluid.

5. The RCD of claim 1, wherein the first fluid line is isolated from the second fluid line.

6. The RCD of claim 1, wherein the plurality of fluid lines extend through the bearing housing and the rotary seal housing toward the plurality of radial passages, and wherein the plurality of fluid lines are defined at discrete circumferential positions.

7. The RCD of claim 6, further comprising at least one bearing fluid line communicating with an internal volume of the bearing housing, wherein the at least one bearing fluid line extends through the bearing housing at a discrete circumferential position.

8. The RCD of claim 1, wherein the plurality of radial passages are isolated from one another via the plurality of rotary seals.

9. The RCD of claim 1, wherein the plurality of rotary seals are supported by a plurality of seal retainers, wherein the plurality of seal retainers define at least some of the plurality of radial passages.

10. The RCD of claim 1, wherein the variable pressure compensating device is configured to operate independently of the pressure compensating piston, and wherein the pressure compensating fluid in the second radial passage is configured to remain unpressurized until the leak across the second rotary seal occurs.

11. The RCD of claim 1, wherein:

the plurality of rotary seals further comprises a third rotary seal positioned axially downstream from the second rotary seal;

the plurality of fluid lines further comprises a third fluid line;

the plurality of radial passages further comprises a third radial passage in communication with the third fluid line;

the variable pressure compensating device is a first variable pressure compensating device;

the RCD further comprises a second variable pressure compensating device positioned in the third fluid line axially downstream from the third rotary seal, wherein the second variable pressure compensating device is configured to build pressure of the pressure compensating fluid in the third radial passage in response to a leak across the third rotary seal;

the second fluid line and the third fluid line are each isolated from the first fluid line and the pressure compensating piston;

the first variable pressure compensating device and the second variable pressure compensating device are each configured to operate independently of the pressure compensating piston;

the pressure compensating fluid in the second radial passage is configured to remain unpressurized until the leak across the second rotary seal occurs; and the pressure compensating fluid in the third radial passage is configured to remain unpressurized until the leak across the third rotary seal occurs.

12. A system comprising:

a rotating control device (RCD) defining a longitudinal passage; and a tubular extending through the longitudinal passage of the RCD in an axial direction;

wherein the RCD comprises:

a drive guide element surrounding the tubular and co-rotating with the tubular;

a bearing housing comprising at least one bearing assembly for rotatably supporting the drive guide element;

a rotary seal housing comprising a plurality of rotary seals surrounding the drive guide element and configured to limit ingress of a working fluid flowing around the tubular into the bearing housing, the plurality of rotary seals arranged in the axial direction, the plurality of rotary seals comprising a first rotary seal and a second rotary seal positioned axially downstream from the first rotary seal;

a plurality of fluid lines in communication with a plurality of radial passages containing a pressure compensating fluid for controlling a pressure differential across the plurality of rotary seals, the plurality of fluid lines comprising a first fluid line and a second fluid line, the plurality of radial passages comprising a first radial passage in communication with the first fluid line and a second radial passage in communication with the second fluid line;

a pressure compensating piston positioned axially upstream from the first rotary seal, the pressure compensating piston configured to build pressure of the pressure compensating fluid in the first radial passage in response to flow of the working fluid to control the pressure differential across the first rotary seal; and a variable pressure compensating device positioned in the second fluid line axially downstream from the second rotary seal, wherein the variable pressure compensating device is configured to build pressure of the pressure compensating fluid in the second radial passage in response to a leak across the second rotary seal to control the pressure differential across the second rotary seal.

13. The system of claim 12, further comprising a fluid system configured to supply the working fluid through the tubular toward a bottom of a wellbore.

14. The system of claim 13, wherein an annulus surrounding the tubular is configured to direct a returning working fluid from the wellbore toward a surface, and wherein the plurality of rotary seals is configured to limit ingress of the returning working fluid into the bearing housing.

15. The system of claim 12, wherein the variable pressure compensating device comprises a piston positioned in a chamber and moveable therein in response to excessive pressure compensating fluid in the second radial passage from the leak across the second rotary seal, wherein the piston is operably coupled with a biasing means that is configured to control movement of the piston in the chamber.

16. The system of claim 12, wherein the pressure compensating piston is positioned in a pressure compensating chamber and moveable therein in response to the flow of the working fluid.

17. A method of operating a drilling system, the method comprising:

supplying a working fluid through a tubular into a wellbore for performing one or more downhole operations using the tubular;

controlling flow of the working fluid returning from the wellbore through an annulus surrounding the tubular using the RCD of claim 1; and isolating the bearing housing from the flow of the working fluid returning from the wellbore using the plurality of rotary seals, wherein, in response to the leak across the second rotary seal, the variable pressure compensating device operates to build pressure of the pressure compensating fluid in the second radial passage to control the leak.

18. The method of claim 17, further comprising building pressure of the pressure compensating fluid in the first radial passage upstream from the second radial passage using the pressure compensating piston.

19. The method of claim 18, wherein the variable pressure compensating device builds pressure in the second radial passage independently of the pressure compensating piston building pressure in the first radial passage.

20. The method of claim 17, wherein, before the leak across the second rotary seal occurs, the pressure compensating fluid in the second radial passage is unpressurized.

* * * * *